US007164103B2

(12) United States Patent
Andersson et al.

(10) Patent No.: US 7,164,103 B2
(45) Date of Patent: Jan. 16, 2007

(54) ELECTRICAL HEATING RESISTANCE ELEMENT

(75) Inventors: Jan Andersson, Västerås (SE); Emil Eriksson, Västerås (SE); Jörgen Sahlström, Hallstrahammar (SE)

(73) Assignee: Sandvik Intellectual Property Aktiebolag, Sandviken (SE)

( * ) Notice: Subject to any disclaimer, the term of this patent is extended or adjusted under 35 U.S.C. 154(b) by 0 days.

(21) Appl. No.: 10/510,143

(22) PCT Filed: Mar. 7, 2003

(86) PCT No.: PCT/SE03/00386

§ 371 (c)(1),
(2), (4) Date: Apr. 19, 2005

(87) PCT Pub. No.: WO03/088716

PCT Pub. Date: Oct. 23, 2003

(65) Prior Publication Data

US 2005/0252909 A1 Nov. 17, 2005

(30) Foreign Application Priority Data

Apr. 5, 2002 (SE) ..... 0201041

(51) Int. Cl.
*H05B 3/10* (2006.01)
*F23Q 7/22* (2006.01)
*H01C 3/08* (2006.01)

(52) U.S. Cl. ..... 219/541; 219/553; 219/270; 219/552; 219/530; 338/217

(58) Field of Classification Search ..... 219/553, 219/270, 260, 552, 541, 530; 338/217
See application file for complete search history.

(56) References Cited

U.S. PATENT DOCUMENTS

| | | | | | |
|---|---|---|---|---|---|
| 2,955,145 | A | * | 10/1960 | Schrewelius | 136/239 |
| 2,992,959 | A | * | 7/1961 | Schrewelius | 428/539.5 |
| 3,269,806 | A | | 8/1966 | Fitzer et al. | 338/333 |
| 3,518,351 | A | | 6/1970 | Ohnsorg et al. | 106/735 |
| 3,607,475 | A | * | 9/1971 | Schrewelius | 216/101 |
| 3,662,222 | A | * | 5/1972 | Ray | 219/260 |
| 3,725,091 | A | * | 4/1973 | Chyung et al. | 428/539.5 |
| 4,101,724 | A | * | 7/1978 | Heine et al. | 373/117 |
| 5,420,399 | A | * | 5/1995 | Sekhar et al. | 219/553 |
| 5,750,958 | A | * | 5/1998 | Okuda et al. | 219/267 |
| 6,563,095 | B1 | * | 5/2003 | Sundberg | 219/553 |
| 6,720,530 | B1 | * | 4/2004 | Taniguchi et al. | 219/270 |
| 6,723,969 | B1 | * | 4/2004 | Beatson | 219/553 |

FOREIGN PATENT DOCUMENTS

| | | | |
|---|---|---|---|
| GB | 834739 | | 5/1960 |
| JP | 05089946 | A * | 4/1993 |
| JP | 05315057 | A * | 11/1993 |

* cited by examiner

*Primary Examiner*—Robin O. Evans
*Assistant Examiner*—Stephen J. Ralis
(74) *Attorney, Agent, or Firm*—Alfred J. Mangels

(57) ABSTRACT

An electrical resistance heating element having a glow zone and two power supply terminals. The glow zone of the element is tubular. A tubular union is provided between each of the power supply terminals and a respective end of the glow zone, wherein the inner diameter of the union is smaller than the inner diameter of the glow zone. A transition region extends between each union and a respective glow zone end and has a progressively decreasing wall thickness in the direction from the union toward the glow zone.

7 Claims, 1 Drawing Sheet

ELECTRICAL HEATING RESISTANCE ELEMENT

BACKGROUND OF THE INVENTION

1. Field of the Invention

The present invention relates to an electrical resistance heating element.

2. Description of the Related Art

Heating elements of the kind described herein are intended for use in heat treatment and sintering processes, in inert and reducing atmospheres, and also oxidizing atmospheres and vacuum conditions, up to extremely high temperatures, such as temperatures as high as 2300° C., but also at low temperatures, e.g., temperatures of 500° C.

Resistance heating elements of the present kind are manufactured by applicants. The resistance heating elements are of a widely varying form and are based on NiCr, FeCrAl, SiC, $MoSi_2$, and alloys of those materials. Those materials are used in a plurality of atmospheres and at different temperatures. Heating elements that are composed mainly of Mo, W, Ta (tantalum), and graphite are used at temperatures around and above 2000° C. In the case of lower temperatures a molybdenum silicide and aluminum oxide composite material is used.

The heating elements include one, two, or more legs, as well as two terminals for connection to a source of electric current. The diameter of the terminals is greater than the diameter of the glow zones of the elements, to reduce the amount of heat generated at the terminals. The elements are in the form of homogenous rods through which electric current flows.

There is a desire to increase the electrical resistance in the glow zone of the element to obtain the same element temperature at a lower current strength, which would greatly lower the power supply operating costs of the elements.

The solution in which the element is provided with a smaller outer diameter, and therewith a higher electrical resistance, results in a smaller element radiation surface, which is highly disadvantageous since a larger radiation gives a larger heat yield through radiation heat. Moreover, thin elements result in mechanical strength problems at high temperatures.

Such desirable attributes are fulfilled by the present invention.

SUMMARY OF THE INVENTION

Accordingly, the present invention relates to an electrical resistance heating element that includes a glow zone and two power supply terminals. The glow zone of the heating element is tubular, and a connecting piece or union means is provided between respective terminals and respective ends of the glow zone.

BRIEF DESCRIPTION OF THE DRAWING

The invention will now be described in more detail, partly with reference to an exemplifying embodiment thereof illustrated in the accompanying drawing, in which.

DESCRIPTION OF THE PREFERRED EMBODIMENTS

Figures 1, 2:
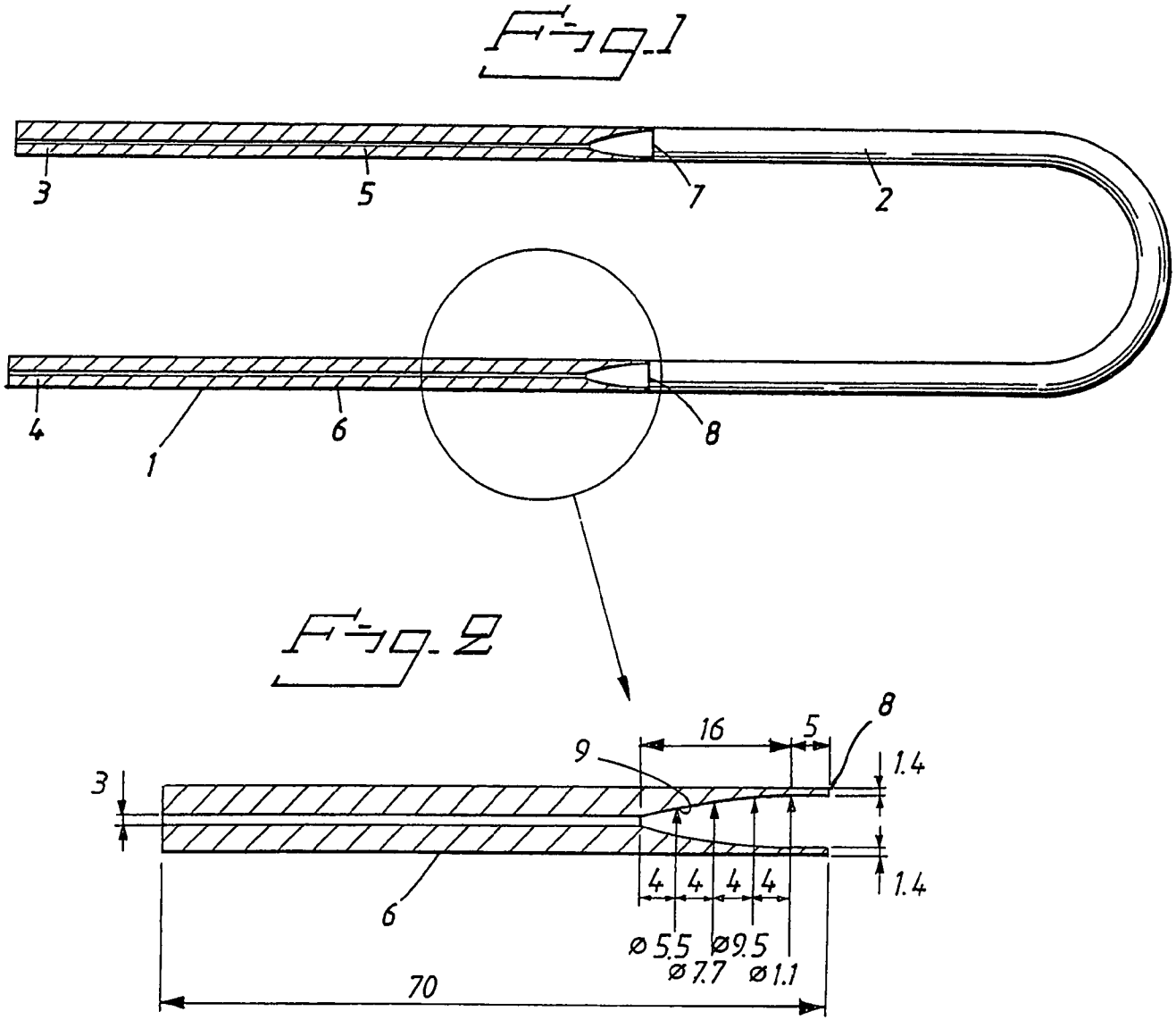
FIG. 1 illustrates a two-leg heating element.
FIG. 2 illustrates union means.

It will be understood that application of the invention is not limited to two-leg heating elements, but that the invention can also be applied to heating elements that have two or more legs.

FIG. 1 is a longitudinal, partially sectioned view of a two-leg heating element 1.

The electrical resistance heating element 1 includes a glow zone 2 and two power supply terminals 3, 4.

According to the invention, the glow zone 2 of the element 1 is tubular. FIG. 1 also shows union means 5, 6 between respective terminals 3, 4 and respective ends 7, 8 of the glow zone 2, Because the glow zone is tubular and has an outer diameter that corresponds to the outer diameter of a corresponding typical heating element, the radiation surface area will be the same. On the other hand, as a result of the smaller cross-sectional area a lower current strength is required through the glow zone in order to obtain the same element temperature. That lower current strength lowers significantly the costs incurred by the element power supply equipment, while providing the same temperature and heat output.

The union means 5, 6 will preferably also be tubular, although with a greater wall thickness, which due to the lower electrical resistance of glow zone 2 will result in a lower union means temperature. The same result applies to the terminals 3, 4.

In order to avoid sharp temperature gradients, the union means 5, 6 have a larger inner diameter at their ends attached to the glow zone 2.

According to one preferred embodiment of the invention, the glow zone 2 has essentially the same inner diameter as the largest inner diameter of the union means 5, 6.

According to another preferred embodiment of the invention, the union means 5, 6 have essentially the same outer diameter as the glow zone 2, while the wall thickness of the union means decreases progressively towards its end facing towards the glow zone, see FIG. 2. FIG. 2 is an enlarged view of the circled area in FIG. 1.

With the intention of adapting the union means to both a welding operation, in which one end of the union means is welded in abutment with the end of the glow zone, and to the operation of the element, it is preferred that the progressively decreasing wall thickness follows a function illustrated in FIG. 2 in which are shown a number of illustrative measurements for various portions of the heating element adjacent to glow zone end 8.

Thus, it is preferred that the progressively decreasing wall thickness results from a variation of the radius at the inner wall surface 9 within a transition region that extends from a smaller inner diameter within union means 6 to a larger inner diameter at glow zone end 8. The radius of the inner wall surface at any axial position along the transition region complies with the function $$r = \frac{ro}{\sqrt{lo}}\sqrt{l},$$

where l coincides with a position along the longitudinal axis of the union means, r corresponds to the inner radius of the union means, lo corresponds to the overall length of the transition region along which the wall thickness decreases, and ro corresponds to the largest inner radius of the union means at a point adjacent to glow zone end 8.

The largest inner radius of the union means is typically 3–5 times larger than the smallest inner radius.

It is also preferred that respective union means 5, 6 and respective terminals 3, 4 together form a one-piece structure.

The resistance elements are produced in different dimensions, for instance with an outer diameter of 9, 12, and 16 mm. The union means dimensions and the glow zone dimensions will, of course, be adapted to each other, for instance in accordance with the above formula.

Typical element proportions may be such that in the case of an element with a glow zone that has an outer diameter of about 12 mm, its inner diameter will be about 10 mm. The union means will have an outer diameter of about 12 mm and a smallest inner diameter of about 3 mm, while the progressively decreasing wall thickness of the union means will extend through a distance of about 16 mm.

The inventive heating element can be produced from all sorts of materials that are produced by applicants, among others, for a number of different applications. Thus, application of the invention is not limited to high temperature elements, but can be applied equally as well for low temperature applications.

The wall thickness of the glow zone can have dimensions other than those given above, depending upon the application concerned, among other things.

The transition between the union means and the glow zone can have a different form, while ensuring that sharp temperature gradients, and therewith thermal stresses are avoided.

The present invention shall not therefore be considered limited to the above described embodiments, since variations can be made within the scope of the accompanying claims.

The invention claimed is:

1. An electrical resistance element comprising: a glow zone and two power supply terminals, wherein the glow zone of the element is tubular; a union extending from each of respective power supply terminals to respective ends of the glow zone, wherein each union is tubular throughout its length and has substantially the same outer diameter as the glow zone, and wherein each union has an end facing towards the glow zone; a transition region adjacent an end of each union and glow zone end, the transition region having a progressively decreasing wall thickness in a direction from the union towards the glow zone, wherein the glow zone has substantially the same inner diameter as the largest inner diameter of the transition region, and wherein the successively decreasing wall thickness is defined by a transition region inner surface having a radius that follows the function $$r = \frac{ro}{\sqrt{lo}}\sqrt{l},$$

where l is a position along the longitudinal axis of the union, r is the inner radius of the transition region at position l, lo is the overall length of the transition region along which the wall thickness decreases, and ro is the largest inner radius of the transition region.

2. A resistance element according to claim 1, wherein the largest inner radius of the transition region is 3–5 times larger than its smallest inner radius.

3. A resistance element according to claim 1, wherein for the element with a glow zone that has an outer diameter of about 12 mm, its inner diameter is about 10 mm, while the union has an outer diameter of about 12 mm and a smallest inner diameter of about 3 mm, and the progressively decreasing wall thickness of the transition region extends through a distance of about 16 mm.

4. A resistance element according to claim 1, wherein a union is welded to each end of the glow zone.

5. A resistance element according to claim 1, wherein a union and a power supply terminal together form a one-piece structure.

6. A resistance element according to claim 1, wherein each union has longitudinally outwardly of the transition region an inner radius that is smaller than the largest inner radius of the transition region and that corresponds with a transition region minimum inner radius.

7. A resistance element according to claim 1, wherein the power supply terminals are tubular.

* * * * *